US005494011A

United States Patent [19]

Haller

[11] Patent Number: 5,494,011

[45] Date of Patent: Feb. 27, 1996

[54] HIGH-RISE INTAKE MANIFOLD FOR PERFORMANCE ENGINES AND METHOD FOR MANUFACTURING SAME

[75] Inventor: Fred T. Haller, 7352 N. Lawndale, Skokie, Ill. 60076

[73] Assignee: Fred T. Haller, Skokie, Ill.

[21] Appl. No.: 324,100

[22] Filed: Oct. 14, 1994

[51] Int. Cl.[6] ..... F02M 35/10

[52] U.S. Cl. ..... 123/184.32; 123/184.34; 123/184.46

[58] Field of Search ..... 123/184.32, 184.46, 123/184.31, 184.34

[56] References Cited

U.S. PATENT DOCUMENTS

| | | | |
|---|---|---|---|
| 1,802,544 | 4/1931 | Vincent | 123/184.31 |
| 2,733,695 | 2/1956 | Goodridge | 123/184.32 |
| 2,762,350 | 9/1956 | Mann et al. | 123/184.32 |
| 2,806,457 | 9/1957 | Moseley | 123/184.32 |
| 2,845,911 | 8/1958 | Gill | 123/184.34 |
| 3,018,767 | 1/1962 | Sailler | 123/184.34 |
| 4,210,107 | 7/1980 | Shaffer | 123/184.34 |
| 4,872,424 | 10/1989 | Carnes | 123/184.32 |
| 4,932,367 | 6/1990 | Newman et al. | 123/184.31 |
| 5,003,932 | 4/1991 | Duncan | 123/184.34 |
| 5,253,616 | 10/1993 | Voss | 123/184.47 |

*Primary Examiner*—David A. Okonsky
*Attorney, Agent, or Firm*—Hill, Steadman & Simpson

[57] ABSTRACT

An intake manifold for a combustion engine is provided. The intake manifold has a body with a front end, a back end, a top and a bottom. The bottom has a first angled portion, a second angled portion and a horizontal portion located therebetween. The intake manifold further has a front end plate and a back end plate connected to respective ends of the body. The top plate has at least one opening for connecting at least one carburetor system to the intake manifold. The intake manifold further has a first and a second engine mounting plate and a plurality of straight tubes each having a first and a second end. The straight tubes are connected at their first end to the body of the intake manifold and at their second end to the engine mounting plates. The plurality of straight tubes are preferably extruded metal. A method for manufacturing an intake manifold for a combustion engine is also provided having the steps of extruding a body, machining a first and second engine mounting plate, a front end plate, a back end plate and a top plate, connecting the front, back and top plates to the body, extruding a plurality of straight tubes and welding the tubes to the body and to the engine mounting plates.

20 Claims, 3 Drawing Sheets

HIGH-RISE INTAKE MANIFOLD FOR PERFORMANCE ENGINES AND METHOD FOR MANUFACTURING SAME

BACKGROUND OF THE INVENTION

The present invention relates generally to combustion engines. More specifically, the present invention relates to a high-rise intake manifold for use with a high performance combustion engine and a method for manufacturing same.

In the field of high performance engines, including drag racing, boat racing and street rod car customizing, the engine and its performance are focal points. The main goal of extracting more power from existing engines is never-ending.

The steps taken to do this, however, are varied and innumerable. A common solution to develop more power from a standard engine is to force more air into the combustion chambers for greater performance. One of the ways this has been done in the past is by mounting a customized or modified intake manifold on an engine. The intake manifold can be customized by designing it in a "high-rise" manner. For example, a standard high-rise intake manifold has a body with runner tubes that are "banana-shaped". Specifically, the runners can be tubes that are curved from the cylinder head up to the body of the high-rise intake manifold.

In addition, the presently known method of manufacturing the "banana-shaped" runner tubes is by casting. In fact, approximately 99% of the runner tubes are manufactured by castings. The custom shapes of the "banana-shaped" runner tubes require a casting method and cannot be extruded. Other types of runner tubes are manufactured from sheet metal.

The above type of runners, however, have certain problems. For example, the airflow therein can be turbulent which decreases overall performance. Also, certain intake manifolds are not strong enough to withstand the pressures developed in high compression engines of the high performance type.

As a result of the above, a high performance high-rise intake manifold that can provide better airflow to the engine while also providing greater strength for better performance and reliability is needed. Also, an improved method for manufacturing an intake manifold for a combustion engine to provide greater strength and better performance is needed.

SUMMARY OF THE INVENTION

The present invention provides an intake manifold for high performance engines having improved strength and airflow capabilities. The present invention further provides an intake manifold that is adaptable to different engine types and performance needs.

To this end, in an embodiment, the present invention provides an intake manifold for a combustion engine having a body with a front end, a back end, a first sidewall and a second sidewall, each sidewall extending from the front end to the back end, a top and a bottom, each extending from the front end to the back end, the bottom having a first angled portion adjacent to the first sidewall, a second angled portion adjacent to the second sidewall and a horizontal portion located between the first angled portion and the second angled portion. Also provided are a first and a second engine mounting plate, and a plurality of straight tubes, each tube having a first and a second end, wherein half of the plurality of straight tubes is connected at its first end to the first angled portion of the body and at its second end to the first engine mounting plate, and wherein the other half of the plurality of straight tubes is connected at its first end to the second angled portion of the body and at its second end to the second engine mounting plate.

In an embodiment, the present invention provides a front end plate connected to the front end of the body and a back end plate connected to the back end of the body. Also, a top plate having at least one opening for connecting at least one carburetor thereto is connected to the top of the body.

The present invention also provides a method for manufacturing an intake manifold for a combustion engine, having the steps of extruding a body, machining a first and a second engine mounting plate, a front end )plate, a back end plate and a top plate having at least one opening connecting the front end plate, the back end plate and the top plate to the body, extruding a plurality of straight tubes, and welding a first end of each of the plurality of straight tubes to the body and welding the other end of half the plurality to straight tubes to the first engine mounting plate and welding the other half of the plurality of the straight tubes to the second engine mounting plate.

It is, therefore, an advantage of the present invention to provide an intake manifold having increased rigidity and structural strength.

Another advantage of the invention is to provide an intake manifold that provides less turbulent airflow to an engine.

A further advantage of the present invention is to provide extruded straight metal runner tubes for improved airflow and performance.

Yet another advantage of the present invention is to provide an intake manifold that is readily manufacturable in a number of embodiments to accommodate various engines.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides an intake manifold for a high performance combustion engine. The present invention also provides a method for manufacturing same.

Figure 1:
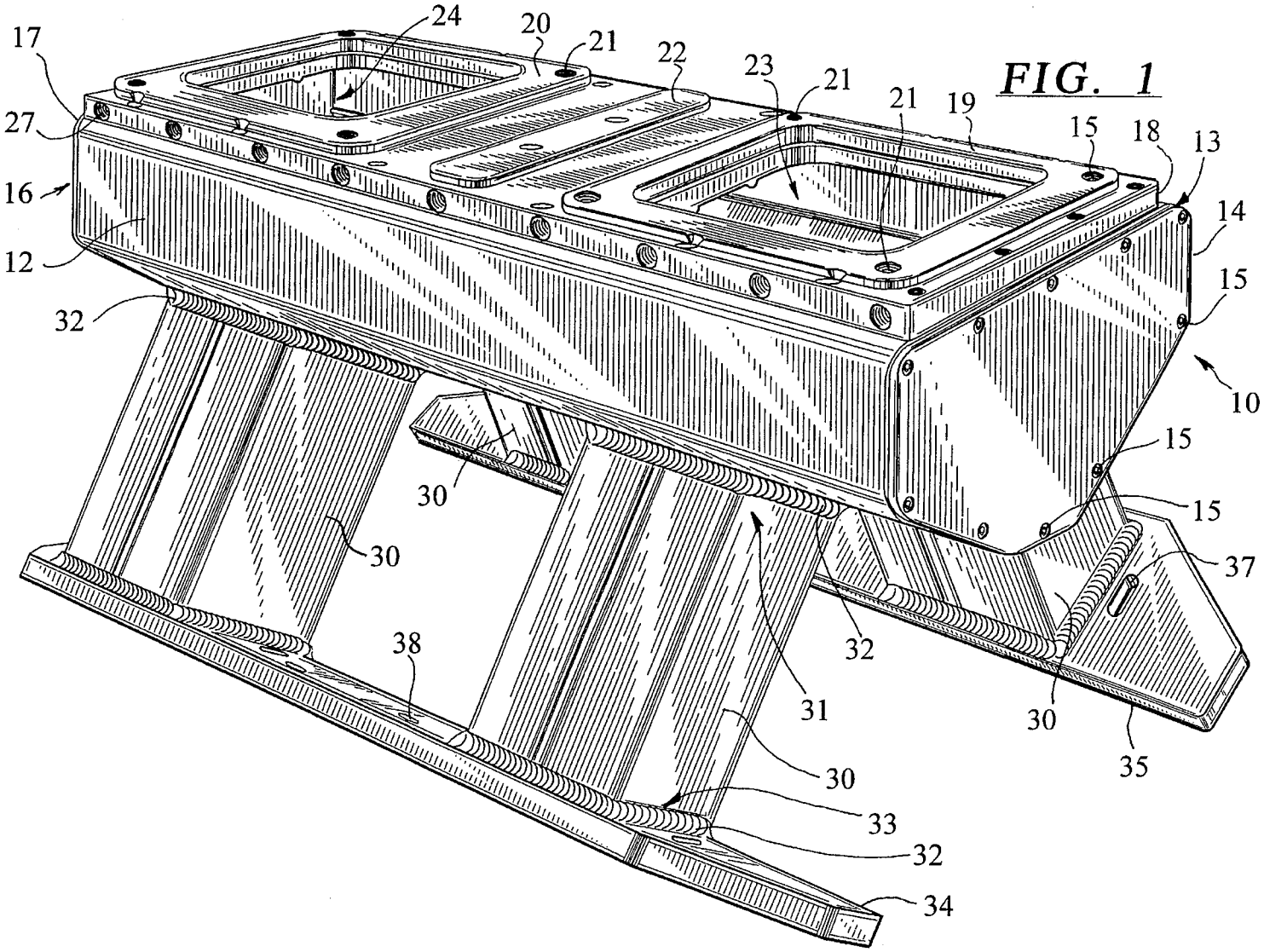
FIG. 1 illustrates a perspective view of an embodiment of an intake manifold of the present invention.

Referring now to an embodiment of the present invention as illustrated in the figures, FIG. 1 shows an intake manifold 10 in perspective view. The intake manifold 10 consists of several component parts. The intake manifold 10 has a body 12. In the embodiment illustrated, the body 12 is a hexagonally-shaped hollow body. The body 12 has a front end 13. A front end plate 14 is secured to the front end 13, for example, by a plurality of Allen screws 15. In addition, the body 12 has a back end 16 with a similar back end plate 17 10 attached thereto by a plurality of Allen screws 15. Thus, the front end plate 14 and the back end plate 17 are typically identical plates.

Also illustrated in FIG. 1 is a top plate 18. The top plate 18 is similarly fastened to the body 12 by a plurality of Allen screws 15. The embodiment of the top plate 18 illustrated in FIG. 1 is but one example of the possibilities envisioned for the present invention. For example, the embodiment shown has a front platform 19 and a back platform 20. The platforms 19, 20 provide a level base for mounting a carburetor or other fuel/air mixing apparatus of an engine. For example, carburetors can be connected to the platforms 19, 20 via platform mounting holes 21. In addition, a center platform 22 is also provided in the embodiment illustrated for further connections, such as carburetor linkage. The center platform 22 provides a surface that is level with respect to the surfaces of the front and back platforms 19, 20.

Also for proper operation of the engine, the top plate 18 has a front opening 23 and a back opening 24. These openings 23, 24 enable an attached carburetor to provide the fuel/air mixture to the engine via the intake manifold 10. Also illustrated in the embodiment of the top plate 18 are a plurality of linkage mounting holes 27. These holes 27 provide connection points for various linkages and other mechanical parts associated with the carburetion system.

Another component of the intake manifold 10 is a plurality of straight runner tubes 30. The tubes 30 have a top end 31 connected to the body 12 of the intake manifold 10. FIG. 1 illustrates a weld 32 as a preferred way of attaching the runner tube 30 to the body 12. Also, the straight runner tubes 30 have a bottom end 33 which may be similarly welded to a first engine mounting plate 34 or a second engine mounting plate 35. The engine mounting plates 34, 35 have a plurality of adjustable mounting holes 37 and a plurality of fixed mounting holes 38 (see FIG. 2).

Figure 2:
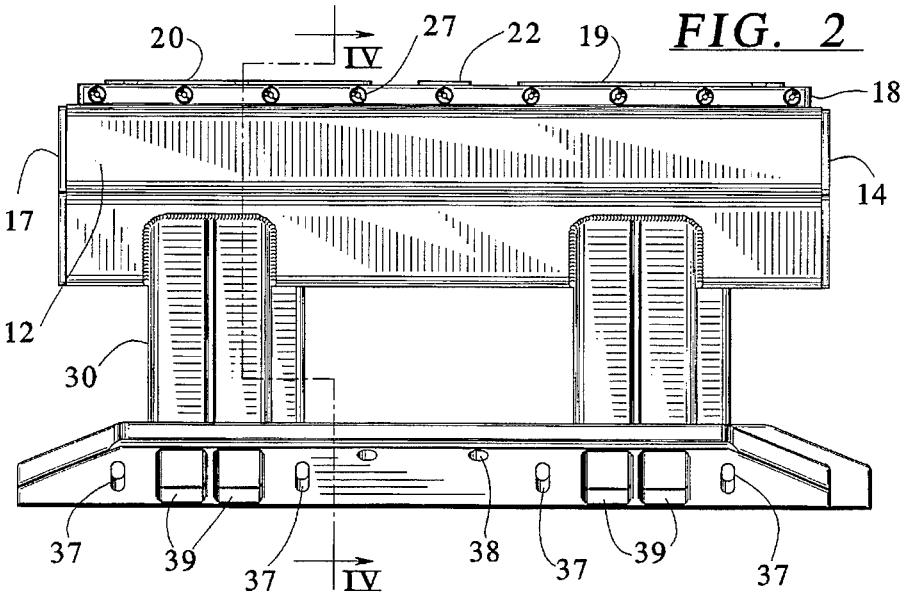
FIG. 2 illustrates a side view of an embodiment of an intake manifold of the present invention.

FIG. 2 illustrates a side view of an embodiment of an intake manifold 10 of the present invention. A plurality of runner bottom ports 39 are illustrated. The runner bottom ports 39 match up and functionally align with the cylinder heads of the engine as shown generally in FIG. 3.

Figure 3:
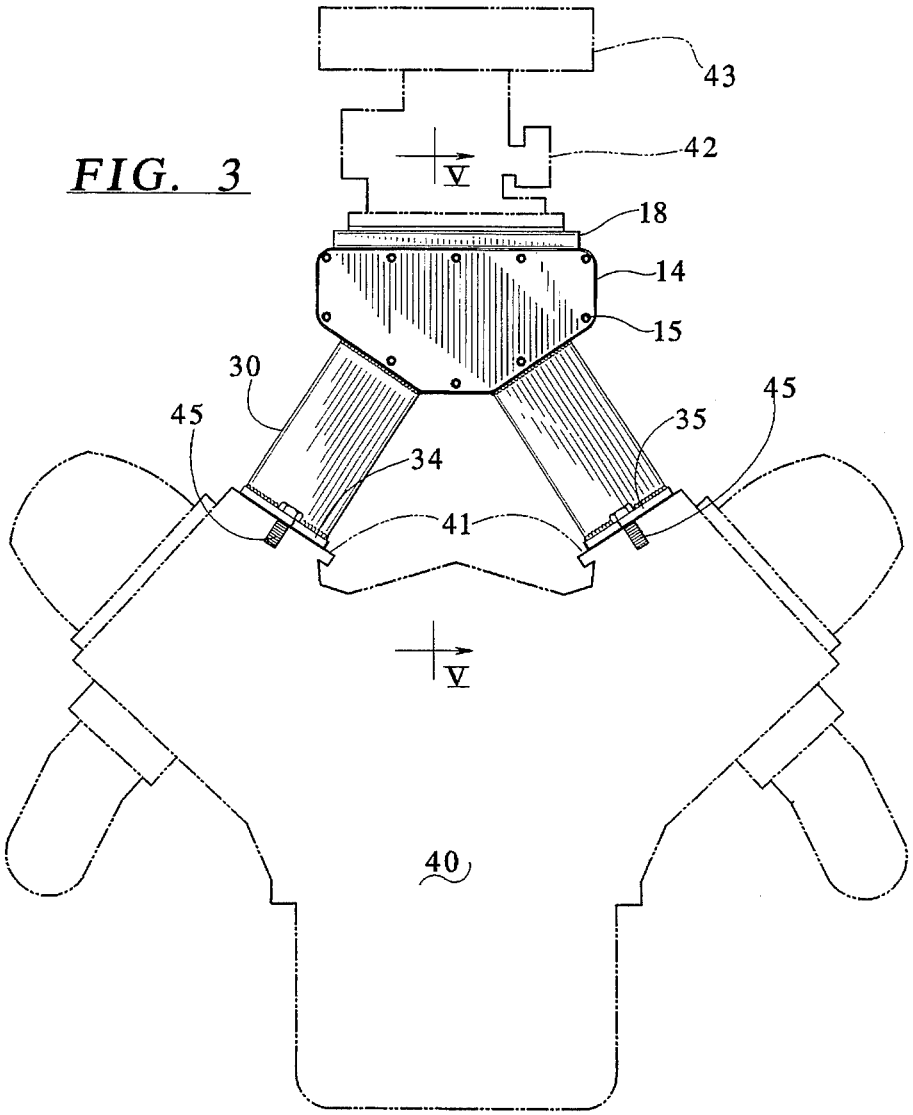
FIG. 3 illustrates a front end view of an embodiment of the present invention mounted on an engine and having a carburetor intake system mounted on top of the intake manifold.

Referring specifically to FIG. 3, the intake manifold 10 of the present invention is shown mounted to an engine 40 via engine cylinder threads 41. Also illustrated in FIG. 3 is a carburetor system 42 and an air cleaner 43. The carburetor system 42 is shown mounted to the top plate 18 of the present invention. A plurality of mounting bolts 45 secure the first and second engine mounting plates 34, 35 to the engine cylinder head 41. Due to the variations in cylinder heads from the various engine makers, the engine mounting plates 34, 35 may be slightly different so that the runner bottom ports 39 properly align with the cylinder heads 41 for proper operation of the engine 40. However, the engine mounting plates 34, 35 are functionally identical.

Figure 4:
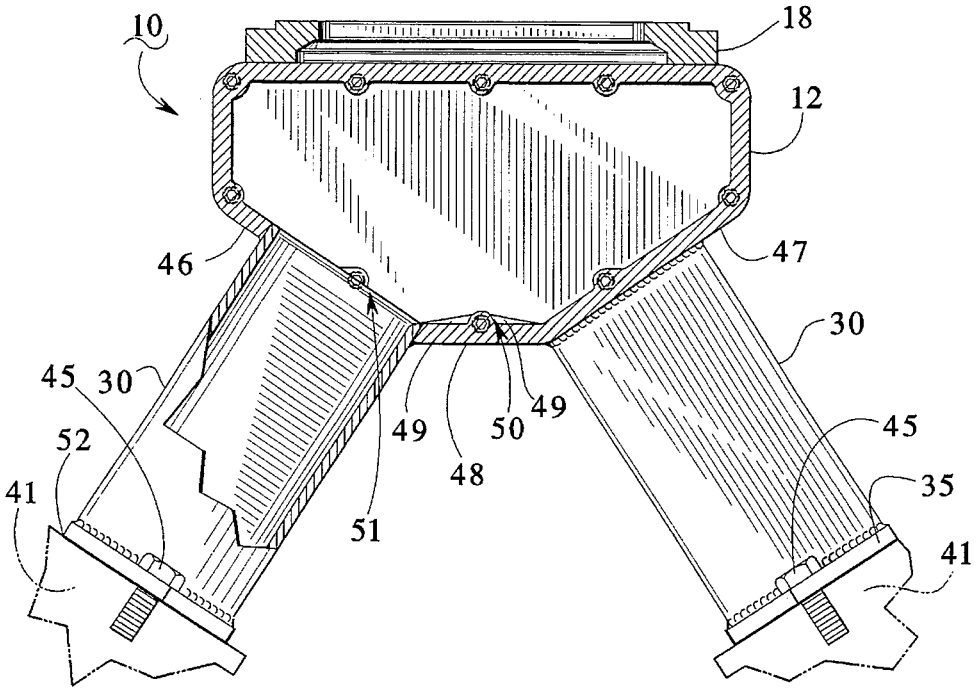
FIG. 4 illustrates a cross-sectional view of an embodiment of the present invention taken generally along the line IV—IV of FIG. 2.

FIG. 4 illustrates a cut-away sectional view taken along section line IV—IV of FIG. 2. This view better illustrates the detail of the body 12 of the intake manifold 10. For example, in the embodiment illustrated, the body 12 has a hexagonal cross-section. As a result, the body 12 has a first angled bottom portion 46 and a similar second angled bottom portion 47 having a 10 horizontal bottom portion 48 located therebetween.

FIG. 4 further illustrates a sloped portion 49 on each side of a side-to-side crest point 50. The sloped portions 49 facilitate drainage of any fuel/air mixture into a top runner hole 51 of the straight runner tube 30. Also illustrated in FIG. 4 is a gasket 52 which seals the engine mounting plates 34, 35 to the engine cylinder head 41 to prevent leakage of any fuel onto the engine.

Figure 5:
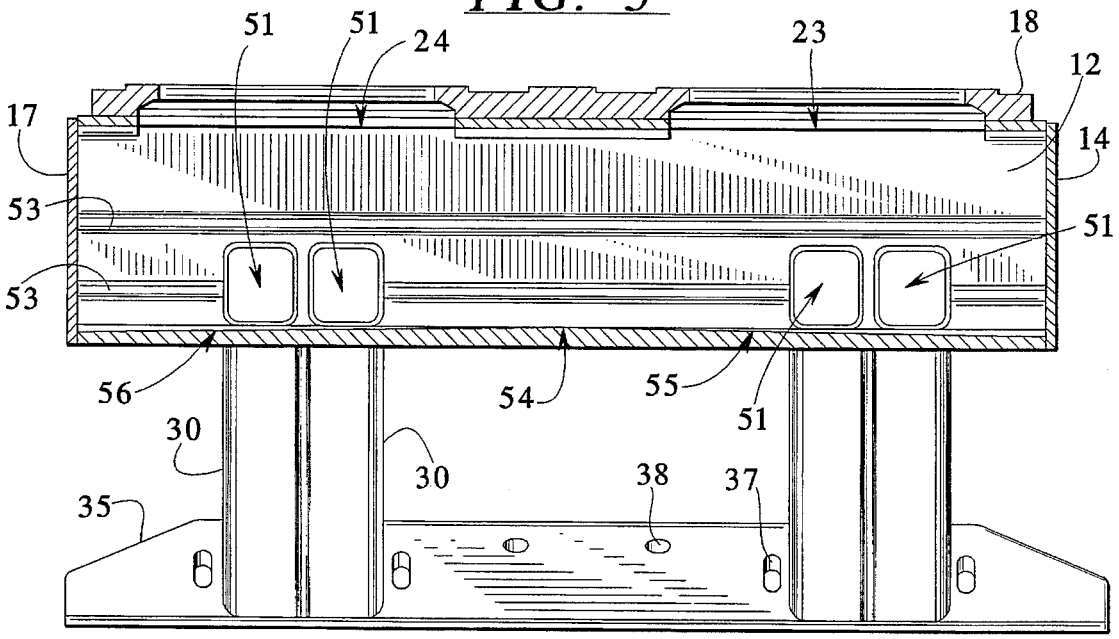
FIG. 5 illustrates a cross-sectional view of an embodiment of the present invention taken generally along the line V—V of FIG. 3.

FIG. 5 illustrates a sectional view taken along line V—V of FIG. 3. A plurality of ribs 53 are provided in the interior portion of the body 12 of the intake manifold 10. The ribs 53 serve at least two functions. First, the ribs 53 provide the necessary metal for securing the end plates 14 to the body 12 via the Allen screws 15. Second, the ribs 53 provide added longitudinal strength and rigidity which stiffens the body 12 of the intake manifold 10. The ribs 53 also reduce flex of the body 12. This is advantageous because the intake manifold 10 is under extreme structural stresses, such as when an engine is performing at high levels. The increased compression pressures and other related harsh environmental conditions that exist in a high performance engine running at full throttle create tremendous stresses on the engine parts including the intake manifold 10 itself. Thus, any structural improvements to the body of the intake manifold 10 are advantageous.

In addition to the side-to-side crest point 50 illustrated in FIG. 4, the intake manifold 10 of the present invention further has a front-to-back crest point 54 to facilitate transporting any excess fuel to the top runner holes 51 of the runner tubes 30. This enables the fuel to be drained down into the cylinder head 41 via the runner tubes 30. Due to the front-to-back crest point 54, the interior of the body thus has a front slope 55 and a back slope 56 which also aid in the drainage.

In addition to the novel features of the intake manifold 10, the present invention also provides a method for manufacturing the intake manifold. To begin with, the intake manifold 10 of the present invention can be embodied in a number of variations in order to operate properly on the various different engines available. For example, the top plate can have a single opening, two openings as shown in FIG. 1 or several openings depending on the number of carburetors or the type of fuel system apparatus used in the engine. Also, the strength and number of Allen screws 15 on the end plates 14, 17 can be increased if greater strength is desired. Also, another variation is that the engine mounting plates 34, 35 can be altered to fit a desired cylinder head 41.

An advantage of the present invention is that all the various embodiments can be manufactured using a single method. The inventive method of the present invention has the steps of extruding a body, machining a first and a second engine plate, a front end plate, a back end plate and a top plate having the desired number or decreased to allow a controlled separation of surfaces in case of excessive pressure developing within manifold. Provide a mean by which to vent excessive from within to the outside. of openings, and connecting the front back and top plates to the body via Allen screws of the desired number and size.

In addition, the method of manufacturing the intake manifold has a step of welding the plurality of the extruded straight runner tubes to the body and welding the other end to the engine mounting plates to form the intake manifold assembly.

A novel feature of the manufacturing of the intake manifold is the extruding of a plurality of straight runner tubes. As discussed above, prior art runner tubes are made from castings approximately 99% of the time. Also, runner tubes can be manufactured from sheet metal. In addition, the prior art runner tubes are usually not straight.

An advantage of the extruded straight runners is that the airflow is more laminar-like. Thus, the less turbulent airflow provides for better operation of the intake manifold of the present invention.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. An intake manifold for a combustion engine, the intake manifold comprising:

a body having a front end, a back end, a first sidewall and a second sidewall, each sidewall extending from the front end to the back end, a top and a bottom, each extending from the front end to the back end, the bottom having a first angled portion adjacent to the first sidewall, a second angled portion adjacent to the second sidewall and a horizontal portion located between the first angled portion and the second angled portion;

a first and a second engine mounting plate; and a plurality of extruded straight tubes, each having a first terminal end and a second terminal end, each tube having a uniform interior cross-section extending from the first terminal end to the second terminal end, wherein at least one of the plurality of extruded straight tubes is flushly fitted at its first terminal end to the first angled portion of the body and at its second terminal end to the first engine mounting plate, and wherein another one of the plurality of extruded straight tubes is flushly fitted at its first end to the second angled portion of the body and at its second terminal end to the second engine mounting plate.

2. The intake manifold of claim 1 further comprising:

a front end plate connected to the front end of the body.

3. The intake manifold of claim 3 further comprising:

a plurality of fasteners to connect the front end plate to the front end of the body.

4. The intake manifold of claim 1 further comprising:

a back end plate connected to the back end of the body.

5. The intake manifold of claim 4 further comprising:

a plurality of fasteners to connect the back end plate to the back end of the body.

6. The intake manifold of claim 6 further comprising:

a top plate connected to the top of the body, the top plate having at least one opening for connecting at least one carburetor thereto.

7. The intake manifold of claim 6 further comprising:

a plurality of fasteners to connect the top plate to the top of the body.

8. The intake manifold of claim 6 further comprising:

a plurality of openings in the top plate.

9. The intake manifold of claim 1 further comprising:

a plurality of ribs in the body.

10. The intake manifold of claim 9 wherein the plurality of ribs are integrally-formed inside the body.

11. The intake manifold of claim 1 further comprising:

a crested interior bottom portion located on the horizontal bottom portion of the body.

12. The intake manifold of claim 1 further comprising:

a side-to-side crest located on the horizontal portion of the body.

13. The intake manifold of claim 1 further comprising:

a front-to-back crest located on the horizontal bottom portion of the body.

14. The intake manifold of claim 1 wherein the first and second ends of the plurality of straight tubes are connected by a plurality of welds.

15. The intake manifold of claim 1 further comprising:

means for connecting linkages on the top plate.

16. The intake manifold of claim 1 further comprising:

at least one adjustable mounting hole in the first engine mounting plate and the second engine mounting plate.

17. A method for manufacturing an intake manifold for a combustion engine, the method comprising the steps of:

extruding a body;

machining a first and a second engine mounting plate, a front end plate, a back end plate and a top plate having at least one opening;

extruding a plurality of straight tubes, each having a first terminal end and a second terminal end and having a uniform interior cross-section extending from the first terminal end to the second terminal end; and welding the first terminal end of each of the plurality of straight tubes to the body such that the first terminal end fits flushly to the body and welding the second terminal end of half the plurality of straight tubes to the first engine mounting plate and welding the other half of the plurality of the straight tubes to the second engine mounting plate.

18. The method of claim 17 further comprising the step of:

extruding a plurality of substantially rectangularly cylindrical straight tubes.

19. The method of claim 17 further comprising the step of:

connecting the front end plate, back end plate and top plate to the body.

20. The method of claim 19 further comprising the step of:

connecting the front end plate, back end plate and top plate to the body with a plurality of fasteners.

* * * * *